US005524599A

United States Patent [19]

Kong et al.

[11] Patent Number: 5,524,599

[45] Date of Patent: Jun. 11, 1996

[54] FUZZY LOGIC AIR/FUEL CONTROLLER

[76] Inventors: Hakchul H. Kong, deceased, late of San Antonio, Tex.; Miyeon Kong, administratrix, 4631 Golden Meadow, San Antonio, Tex. 78250

[21] Appl. No.: 184,232

[22] Filed: Jan. 19, 1994

[51] Int. Cl.[6] ..... F02D 41/14

[52] U.S. Cl. ..... 123/682; 364/431.05

[58] Field of Search ..... 123/682, 683; 364/431.05, 431.06

[56] References Cited

U.S. PATENT DOCUMENTS

| | | | |
|---|---|---|---|
| 4,492,211 | 1/1985 | Shimomura et al. | 123/682 |
| 4,881,505 | 11/1989 | Tomisawa | 123/480 |
| 4,889,099 | 12/1989 | Tomishawa | 123/674 |
| 4,926,826 | 5/1990 | Nakaniwa et al. | 123/696 |
| 5,001,643 | 3/1991 | Domino et al. | 364/431.06 |
| 5,065,728 | 11/1991 | Nakaniwa | 123/683 |

FOREIGN PATENT DOCUMENTS 3-23332 1/1991 Japan .

OTHER PUBLICATIONS

Dr. H. Kong, "Engine Control: In Search of an Inexact Solution", *Technology Today*, Sep. 1991.

Ashok Nedungadi, Dennis J. Wenzel, "A Novel Approach to Robot Control Using Fuzzy Logic", Aug. 2, 1991.

*Primary Examiner* Andrew M. Dolinar

*Attorney, Agent, or Firm* Baker & Botts

[57] ABSTRACT

A fuzzy logic controller for determining the air/fuel ratio of air and fuel to be delivered to an engine. The fuzzy logic controller has four input signals, two based on an air/fuel ratio feedback measurement, one based on throttle position, and one based on vehicle speed. The controller uses these inputs to obtain an "error" signal and its derivative, which are each converted to fuzzy antecedents for an inferential rule set. Application of the rule set produces at least one fuzzy output, which is defuzzified to produce a desired air/fuel ratio.

12 Claims, 3 Drawing Sheets

FUZZY LOGIC AIR/FUEL CONTROLLER

TECHNICAL FIELD OF THE INVENTION

This invention relates to automatic control systems, and more particularly to a device for controlling the air and fuel delivered to an internal combustion engine.

BACKGROUND OF THE INVENTION

Gasoline engines are a type of internal combustion engine characterized by the fact that the fuel is burned inside the engine. An example of an internal combustion engine is the automobile engine, which works by burning a mixture of gasoline and air in a cylinder containing a piston. This produces heat, which causes the air to expand and force down the piston. The piston turns a crankshaft linked to the wheels.

The amounts of air and fuel mixed in the cylinder is an important parameter in the operating characteristics of the equipment that the engine drives. The air intake is controlled by a throttle, which in the case of an automobile, responds to the driver's operation of an accelerator pedal. Fuel intake is controlled by some sort of fuel valve, which computes a fuel input quantity, F. In the case of an automobile, the fuel input is commonly controlled by a fuel injection valve.

In conventional air/fuel control systems for gasoline engines, a fuel input quantity derived from a basic fuel injection quantity, $F_B$, is modified by an air/fuel ratio feedback correction coefficient, LAMBDA. Typically, a value for LAMBDA is obtained by sensing the oxygen concentration in the engine exhaust. Other correction coefficients, COEFF, which represent various driving conditions, may also be factored in. Thus, in general, the final fuel input quantity, F, may be expressed as:

$$F=F_B \times COEFF \times LAMBDA.$$

A pulse signal having a pulse width corresponding to the desired fuel input quantity is delivered to the fuel intake valve, which delivers that amount of fuel to the engine.

In many of these conventional air/fuel control systems, the correction coefficient, LAMBDA, is calculated on the basis of proportion-integration-derivative (PID) control. However, a characteristic of PID controllers is that they are designed for linear systems. Some sort of accommodation must be made for nonlinearities, such as is the case with the output of many standard exhaust oxygen sensing devices.

Another approach to air/fuel control is a heuristic approach, which involves using a lookup table to store an appropriate output value for each set of input values. These input values may include the air/fuel ratio as detected in the engine exhaust, as well as other variables. The values entered into the table are chosen by expert knowledge and experimentation. However, a problem with this type of air/fuel control is that it requires substantial memory space for the lookup table. This increases the complexity and cost of the control system.

A need exists for an air/fuel control system that operates well with existing exhaust sensing devices, and that does not have substantial memory storage requirements.

SUMMARY OF THE INVENTION

A first aspect of the invention is a controller for calculating the ratio of air and fuel to be delivered to an internal combustion engine. A comparator receives the output signal from a conventional EGO sensor and converts it to a positive/negative pulse signal, where one state represents a rich mixture and the other state represents a lean mixture. A counter counts the duration of each state. This data is delivered to a processing unit, which also receives sampled values of a throttle position signal and of a vehicle speed signal. The processor calculates values of a duration time function, based on the duration time values, and a driving conditions function, which is based on derivatives of the throttle position and vehicle speed data. The processor uses these values, as well as the positive/negative pulse signal, as inputs to stored algorithms for calculating an estimated air/fuel ratio and for calculating an air/fuel ratio derivative. The resulting values are converted to fuzzy membership values, which are used as antecedents to a rule base. The output of the rule base is a fuzzy membership value, which the processor converts to a value representing a desired air/fuel ratio.

A technical advantage of the invention is that it may be implemented with input from a conventional exhaust gas oxygen sensor. It results in narrower A/F fluctuations than conventional controllers, which reduces emissions and improves fuel economy. The controller has a small computational burden and memory space requirement, as compared to other processor-based A/F controllers, which permits its to be implemented with a less expensive microprocessor system.

DETAILED DESCRIPTION OF THE INVENTION

Figure 1:
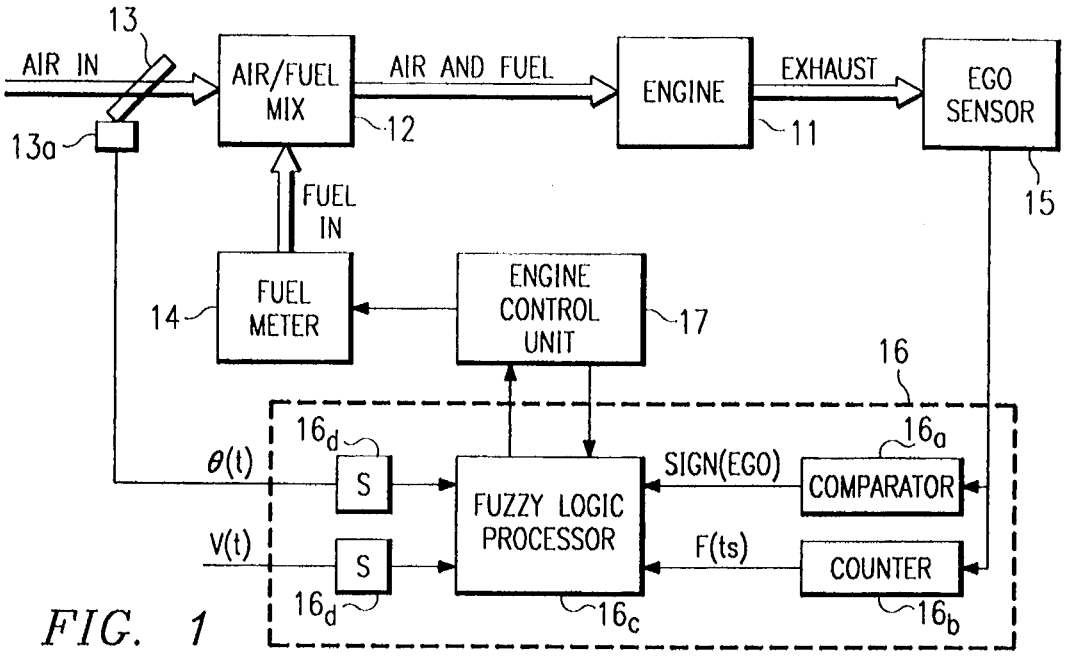
FIG. 1 is a block diagram of the physical components of an air/fuel control system for an internal combustion engine, having a closed feedback loop for fuzzy logic control in accordance with the invention.

FIG. 1 is a block diagram of the physical components of an air/fuel control system for an internal combustion engine, having a closed feedback loop with a fuzzy logic controller 16 in accordance with the invention.

Engine 11 is any type of internal combustion engine, in which air and fuel are mixed prior to combustion. For purposes of this description, engine 11 is assumed to be a conventional fuel injection type engine, in which air and fuel are delivered to some sort of internal chamber 12, such as the piston cylinder of a conventional automobile.

Air is delivered to chamber 12 via an air intake line having a throttle 13 for adjusting the quantity of air so delivered. The throttle 13 responds to mechanical movement of an accelerator pedal. A throttle angle sensor 13*a* produces an electrical signal indicative of the throttle angle, Θ.

Fuel is delivered to chamber 12 via a fuel intake line having a fuel input valve 14 for adjusting the quantity of fuel delivered to engine 11. An example of fuel input valve 14 is a conventional fuel injection valve.

Engine 11 has an exhaust line, in which an exhaust gas oxygen (EGO) sensor 15 is installed. Sensor 15 is a conventional EGO sensing device, which measures the oxygen concentration in the exhaust gas, as compared to ambient air. EGO sensor 15 is a switching type sensor, whose output abruptly changes according to whether the oxygen concentration is indicative of a rich or a lean mixture.

Figure 2:
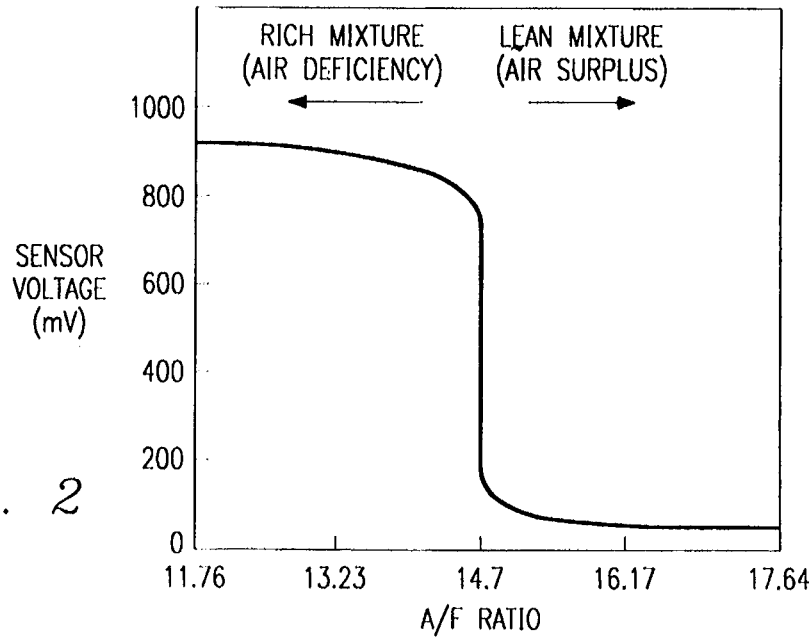
FIG. 2 illustrates the output voltage characteristics of the EGO sensor of FIG. 1.

FIG. 2 illustrates the output voltage characteristics of EGO sensor 15. The EGO output represents an A/F ratio, where, for example, a value of 14.7 represents the amount of air that would be present for a stoichiometric air/fuel ratio. A value of less than 14.7 represents a rich mixture of air and fuel, such that the exhaust oxygen concentration is deficient. A value greater than 14.7 represents a lean mixture of air and fuel, such that the exhaust oxygen is excessive. Where the oxygen is deficient, sensor 15 produces a "high" voltage, whereas when the oxygen is excessive, sensor 15 produces a "low" voltage. The voltage switches abruptly between high and low at the threshold of the stoichiometric A/F ratio.

The output of sensor 15 is delivered to a comparator unit 16*a*, which converts the voltage signal to a positive/negative pulse signal, SIGN(EGO). Using the example of FIG. 2, an output of over 500 millivolts is converted to a positive pulse, whereas an output of 500 millivolts or less is a negative pulse.

Figure 3:
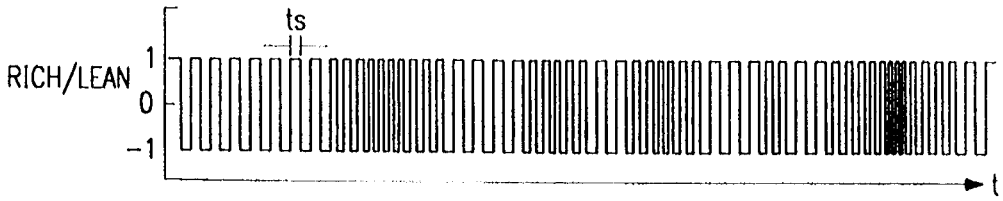
FIG. 3 illustrates the SIGN(EGO) signal generated by the comparator of FIG. 1.

FIG. 3 illustrates the SIGN(EGO) signal generated by comparator unit 16*a*. The sign changes represent changes in the exhaust oxygen, as compared to the stoichiometric ratio, from rich (+1) to lean (−1). In general, the duration time, ts, of each state is different from the next duration time. The longer the duration time of each state, the more chance there is of a rich or lean mixture.

The output of EGO sensor 15 is also delivered to a counter 16*a*. Counter 16*b* counts the duration time, ts, of each state (rich or lean) of EGO sensor 15. Typical values of ts range from 0.5 seconds to 2.0 seconds.

Figure 4:
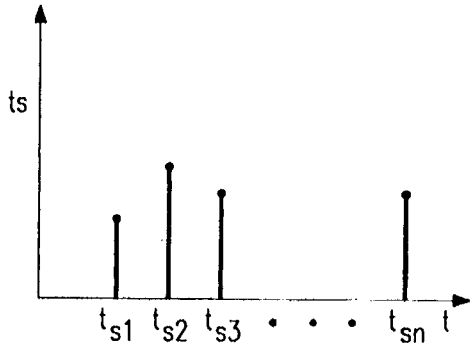
FIG. 4 illustrates how the values of ts from FIG. 3 may vary at different times.
Figure 5:
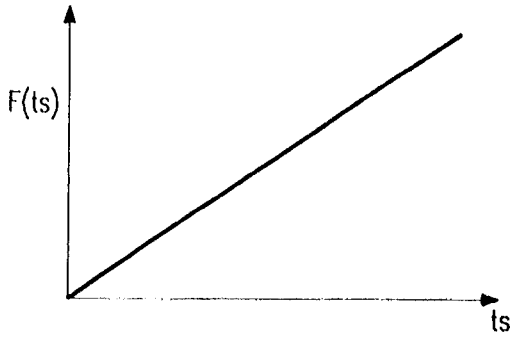
FIG. 5 illustrates the general behavior of the function, F(ts).

FIG. 4 illustrates the output of counter 16*b*, a set of values of ts, where each change of state of the EGO sensor output results in a new measurement of ts. FIG. 5 illustrates the general behavior of the function F(ts), which in its simplest form, may be a linear function that increases as ts increases, such as F=ts.

Referring again to FIG. 1, the signal, SIGN(EGO) and values of ts, from comparator 16*a* and counter 16*b*, respectively, are delivered to fuzzy logic processor 16*c*. Two additional inputs to fuzzy logic controller 16 are the throttle angle signal, Θ(t), from sensor 13*a*, and a vehicle speed signal, v(t). Sampling circuits 16*d* provide sampled values of these input signals.

Apart from comparator 16*a* and counter 16*b*, fuzzy logic controller 16 is essentially a processor system 16*c*. The processor performs computing functions according to a program stored in the memory. In the preferred embodiment, the memory is a read only memory (ROM) that permanently stores the program, as well as the rule set discussed below in connection with FIG. 4. Alternatively, fuzzy logic controller 16 may be a dedicated fuzzy logic system having a rule set memory, an inference processor, I/O circuitry, and hardwired circuitry for performing mathematical calculations.

Engine control unit 17 is a type found in many of today's engine control systems. As explained below, engine control unit 17 receives the output of fuzzy logic controller 16, which is a desired A/F ratio; and translates this value into input for a fuel meter 14. Also, engine control unit 17 may provide timing signals to fuzzy logic controller 16 for controlling sample timing, output synchronization, etc.

Figure 6:
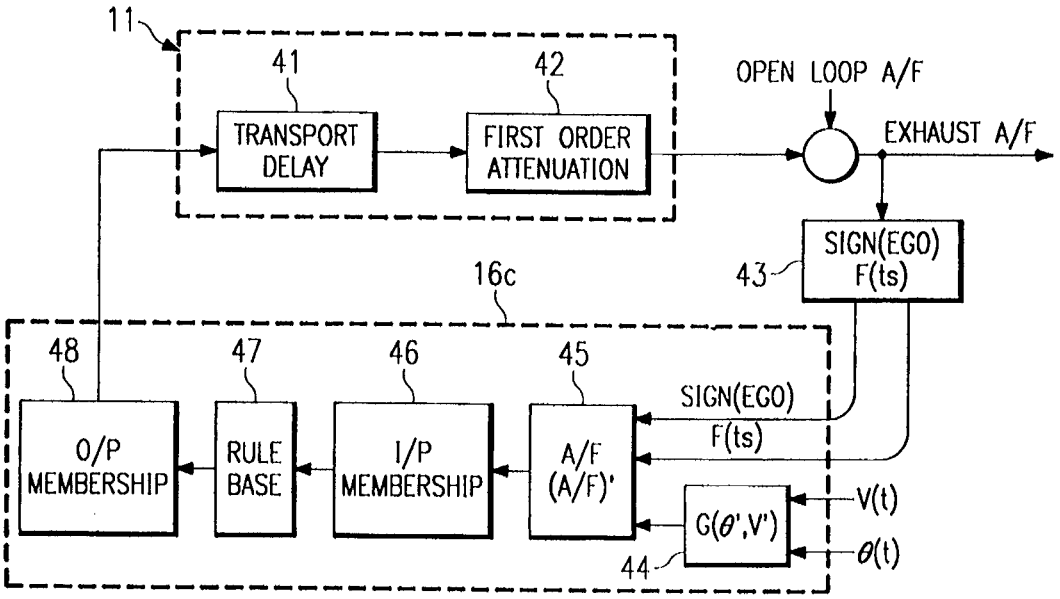
FIG. 6 illustrates the processing steps of the feedback loop of FIG. 1, especially the operation of the fuzzy logic controller.

FIG. 6 illustrates the processing steps of the feedback loop of FIG. 1, including the tasks performed by fuzzy logic processor 16*c*. The open loop portion of the system provides a stoichiometric air/fuel ratio to comparator 16*a*. The closed loop feeds back the EGO sensor output, the throttle position signal, and the vehicle speed signal to fuzzy logic processor 16*c*.

As indicated in FIG. 6, the engine 11 to be controlled has a first order inertial element 41 and a time-lag element 42. In a typical engine 11, these modifying factors can be expressed as $e^{-Ts}$ and 1/1+Ts, respectively.

As an overview of the process of FIG. 6, it is an iteratively adjusting process. Values of SIGN(EGO), F(ts), V(t), and Θ(t) are used as input values to a stored algorithm for calculating an estimated value, A/F. Then, the derivative, (A/F)', is calculated. These values of A/F and (A/F)' are converted to fuzzy representations, a rule base is applied to produce a fuzzy solution, and the solution is defuzzified to obtain a precise value for a desired A/F ratio. This A/F value is related to a fuel flow value, which in turn is related to a fuel intake pulse width. Meanwhile, the resulting engine conditions are being sensed to provide the next set of fuzzy logic inputs.

More specifically, in step 43, comparator 16*a* and counter 16*b* provide values of SIGN(EGO) and F(ts). Although not explicitly drawn, processor 16*c* may include timing means for providing input values at predetermined time intervals.

Figure 7:
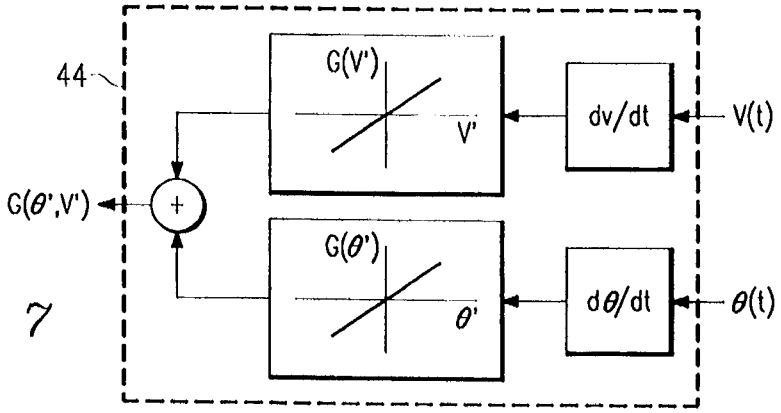
FIG. 7 illustrates the derivation of the function, G(Θ', v').

In step 44, processor 16*c* accesses a stored function G(Θ', v'), which is a function of the rate of change of the throttle angle and of the rate of change of the vehicle speed. To calculate values of this function, processor 16*c* first calculates the time derivative of Θ(t) and the time derivative of v(t). These derivatives may be expressed as Θ' and v', respectively FIG. 7 illustrates how the function G(Θ', v') is a composite of two functions G(Θ') and G(v'). Essentially, when Θ' or v' is positive, G is negative. When Θ' or v' is negative, G is positive. The function, G(Θ', v'), can be represented graphically as the sum of two two-dimensional functions of a single variable, or as a three-dimensional function of two variables. In the preferred embodiment, the function G is refined experimentally to obtain optimum results. Because it is based on throttle position and vehicle speed, it is referred to herein as a "driving conditions" function.

In step 45, processor 16*c* accesses and executes a stored algorithm for calculating an estimated air/fuel ratio. It uses sampled values of SIGN(EGO), F(ts), and G(Θ', v') as inputs:

$$A/F=(A/F)_o+SIGN(EGO)*(\alpha F(ts)+\beta G(\Theta', v')),$$

where $(A/F)_o$ is the stoichiometric air/fuel ratio, sign (EGO) is +1 or −1 as determined by comparator 16*a*, and α and β are weighing factors for the functions F and G respectively. The weighing factors are used to adjust the range of values required for analog to digital and digital to analog converters to a range more suited to fuzzy logic controller 16. Their derivation is known in the art of fuzzy logic control.

The calculated A/F value is an "error" signal in the sense that it represents a value that can be compared with a stoichiometric A/F ratio. However, this comparison includes both an F function, which is based on a feedback air/fuel measurement and a G function, which is based on a current driving conditions. As stated above, F is a function of ts, the time between sign changes of the output of EGO sensor 15. G is a function of Θ', the throttle rate, and of v', the vehicle speed.

Also, in step 45, processor 16*c* accesses and executes an algorithm for differentiating the above equation with respect to time. It calculates a value for (A/F)'. This calculation may be expressed as:

$$(A/F)'=SIGN(EGO)*(\alpha F*dG/dt+\beta G*dF/dt).$$

For purposes of example, it is assumed that step 45 results in values of 13.5 and 6.25 for A/F and (A/F)', respectively.

In step 46, both the estimated air/fuel ratio, A/F, and its derivative, (A/F)', are "fuzzified". In fuzzy logic, decision making is modeled on the kind of imprecision found (intentionally or not) in human reasoning. Through fuzzy logic, the model represents imprecise concepts. Truth is represented on a scale of 0 to 1. A value of 1 represents completely true, a value of 0 represents completely false, and intermediate values represent varying degrees of truth. The numerical value for a degree of truth is often referred to as a "belief value" or "degree of membership". For example, a degree of membership of 0.7 indicates that a supposition is believed to be 70% true.

Figure 8:
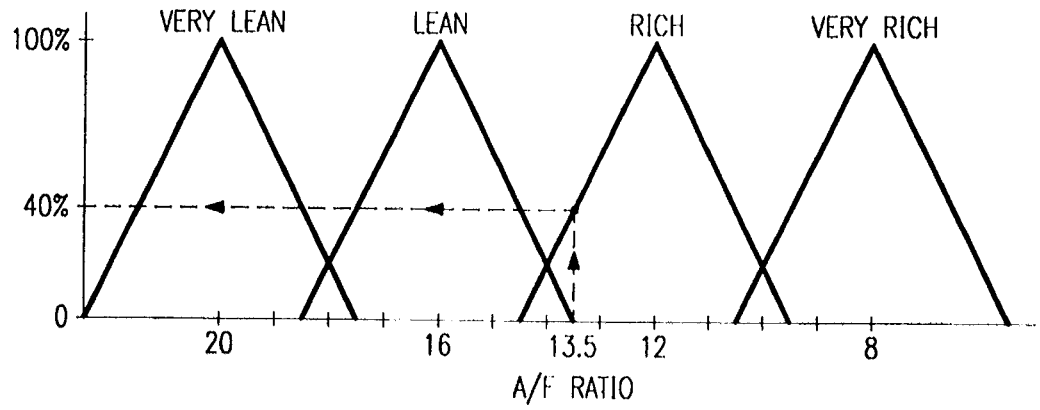
FIG. 8 illustrates the membership functions for values of the calculated air/fuel ratio, A/F.

FIG. 8 illustrates the membership functions for various linguistic representations of the calculated air/fuel ratio, A/F. Each linguistic representation, i.e., "very lean", "lean", "optimum", etc. has a triangular shaped function with a range of A/F values. For example, the "rich" membership function corresponds to A/F values centered around a value of 12, which represents a normalized ratio of 12:1. It should be understood that for a particular domain of possible A/F ratios, fewer (or more) linguistic representations could be used, each having a smaller (or larger) range of values.

Each calculated value of A/F is a "fuzzy quantity", with an associated belief value in one or more membership functions. In the example of FIG. 8, a typical stoichiometric A/F value is 14.7, and the calculated A/F values range from 10 to 20. As indicated by the dotted lines, a calculated A/F value of 13.5 would represent a 40% belief value that "rich" is true.

Figure 9:
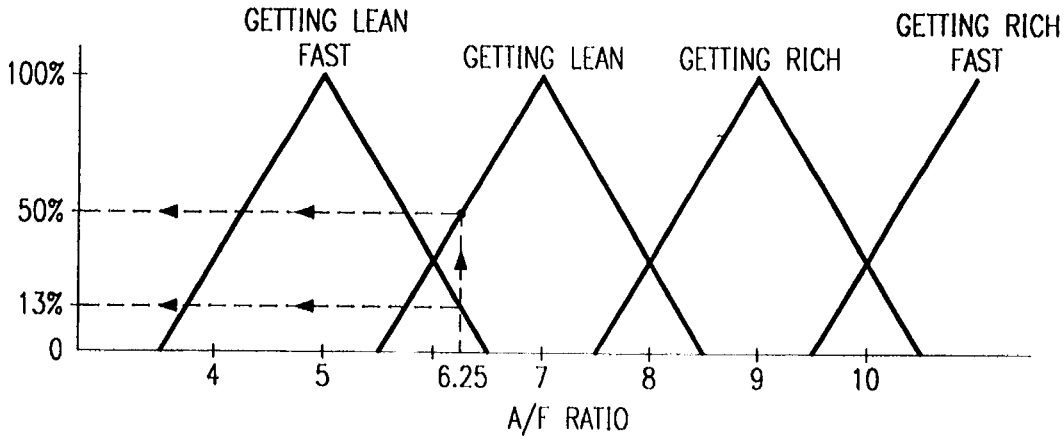
FIG. 9 illustrates the membership functions for values of the derivative of the air/fuel ratio, (A/F)'.

FIG. 9 illustrates a set of membership functions for linguistic representations of the derivative of the air/fuel ratio, (A/F)'. Examples of these linguistic representations could be "getting lean quickly", "getting lean", "getting rich", and "getting rich quickly". Each of these representations, .in mathematical terms, is a fuzzy set variable.

In the example of FIG. 9, calculated values of (A/F)' vary around a value of 7. As an example of fuzzification, a A/F value of 6.25 would represent a 50% belief that the mixture is getting lean. It also would represents a 13% belief that the mixture is getting lean fast.

Thus, at a given sampling interval, the fuzzifier takes numerical values for A/F and (A/F)' and uses them as inputs to membership functions to obtain linguistic representations. It should be understood that although triangular membership functions are used herein, other types of membership functions, such as trapezoidal or bell shaped, could be used. Given a precise value, its fuzzification into a linguistic representation is known in the art of mathematics.

In step 47, processor 16*c* applies the linguistic representations to a rule base, which is a set of if-then rules that represents an air/fuel control strategy. These inference rules state what the control output should be for a given input. These rules are developed heuristically, using as a basis, past experience and knowledge of the air/fuel control process. The rules determine the fuel injector pulse width.

As an example, a rule might be stated linguistically as follows:

If the A/F ratio is "rich" and its derivative is "getting lean", then do not change the fuel injector pulse width. i.e., stay "rich".

As another example:

If the A/F ratio is "very lean" and its derivative is "getting lean", then increase the fuel injector pulse width by a large amount. i.e., go to "very rich".

It should be noted that the rules state the desired pulse width in fuzzy terms, such as "rich". Also, several rules may be each partially applicable, and thus the rules might indicate that the pulse width should be set to different values. In the example of this description, where the value for (A/F)' resulted in two membership functions, more than one rule might apply.

Figure 10:
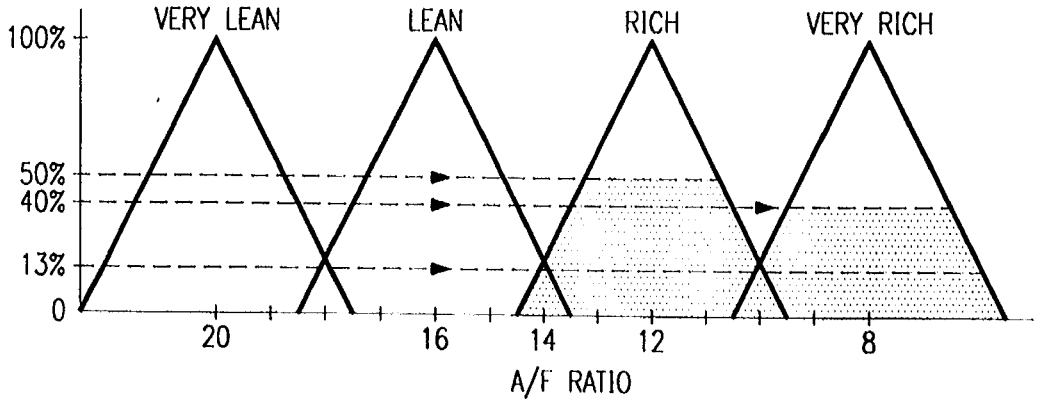
FIG. 10 represents the membership functions for the output of the fuzzy logic controller.

FIG. 10 represents the output membership functions for the results of step 47. For example, the "rich" membership function represents the decision that the A/F ratio next delivered to the engine 11 should be within a range of values that is considered "rich".

In step 48, processor 16*c* performs a defuzzification process to resolve conflicts and to convert the fuzzy representation into a numerical value.

FIG. 10 uses the example of FIGS. 8 and 9, with the single membership for the calculated A/F and the two memberships for the calculated (A/F)' resulting in the application of two different rules with two different solutions. To determine the output value when there is more than one output membership function, various calculation techniques may be used. One such method is a geometric centroid method, in which the maximum belief values for each input membership function are used to define a trapezoidal portion of each output membership function. Then, the centroid of the resulting shape is calculated. The corresponding A/F value is the output value. Alternative defuzzification techniques other than centroid calculation are known in the art of fuzzy logic.

The output of the fuzzy logic controller 16 is a desired A/F ratio of the fuel and air to be delivered to the engine 11. This ratio is used by known techniques to obtain an injector pulse width. In general, a mass air flow quantity, Ma, is divided by A/F to obtain a mass fuel flow value, Mf. This Mf value can be related to a required pulse width for that fuel flow. The pulse width value is used to control fuel meter 14. Typically, these calculations are performed by engine control unit 17.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fuzzy logic controller that receives an exhaust gas sensor signal indicating whether an air/fuel mixture in an internal combustion engine is in a lean or rich state and that provides an output value for controlling said air/fuel mixture, comprising:

means for detecting each said rich or lean state, thereby providing a positive/negative signal;

means for counting the duration time of each said rich or lean state, thereby providing a duration time signal;

means for generating throttle position derivative values;

means for generating vehicle speed derivative values;

a processor for calculating an air/fuel ratio from values of said positive/negative signal and said duration time signal, and from said throttle position derivative values and said vehicle speed derivative values, for calculating an air/fuel ratio derivative of said air/fuel ratio, for converting said air/fuel ratio and said air/fuel ratio derivative to fuzzy logic inputs, for applying a set of rules for inferring a fuzzy logic output from said fuzzy logic inputs, and for converting said fuzzy logic output to said output value; and a memory for storing programming used by said processor and for storing said set of rules.

2. The controller of claim 1, wherein said means for detecting is a comparator.

3. The controller of claim 1, wherein said means for counting is a digital counter.

4. The controller of claim 1, wherein said means for generating said throttle position derivative values and said means for generating said vehicle speed derivative values are analog differentiators.

5. The controller of claim 1, further comprising means for sampling a throttle position signal and a vehicle speed signal, and wherein said means for generating said throttle position derivative values and said means for generating said vehicle speed derivative values are said processor.

6. The controller of claim 1, wherein said memory stores a duration time function of said duration times, and wherein said processor calculates said air/fuel ratio from values of said duration time function.

7. The controller of claim 1, wherein said processor is programmed to calculate said air/fuel ratio from the following formula:

$$A/F=(A/F)_o+SIGN(EGO)*(\alpha F(ts)+(\beta G(\Theta', v')),$$

where A/F represents said air/fuel ratio, $(A/F)_o$ represents a stoichiometric air/fuel ratio, SIGN(EGO) represents said positive/negative pulse signal, F(ts) represents a function of said duration times, $G(\Theta', v')$ represents a function of said derivative values, and $\alpha$ and $\beta$ are weighing factors.

8. The controller of claim 1, wherein said memory stores a driving conditions function of said throttle position derivative values and said vehicle speed derivative values, and wherein said processor calculates said air/fuel ratio from values of said driving conditions function.

9. A processor system for use in an internal combustion engine having an exhaust gas sensor, a throttle position sensor, and a vehicle speed sensor, and for providing an output value for controlling the air/fuel mixture to be delivered to the engine, comprising:

a processor programmed to calculate throttle position derivative values from a signal provided by said throttle position sensor and to calculate vehicle speed derivative values from a signal provided by said vehicle speed sensor, and to calculate an air-fuel ratio from a positive/negative pulse signal, in which each pulse represents a duration of a rich or lean state as detected by said exhaust gas sensor, from a signal representing the duration time of each said rich or lean state, from said throttle position derivative values, and from said vehicle speed derivative values, said processor further programmed to calculate an air/fuel ratio derivative of said air/fuel ratio, and said processor further programmed to derive fuzzy logic inputs from said air/fuel ratio and said air/fuel ratio derivative, to apply said fuzzy logic inputs to a set of rules representing an air/fuel control strategy, thereby providing a fuzzy logic output, and to derive said output value from said fuzzy logic output;

a memory for storing fuzzy logic inputs, said set of rules and fuzzy logic outputs.

10. The processor system of claim 9, wherein said memory stores a duration time function of said duration times, and wherein said processor calculates said air/fuel ratio from values of said duration time function.

11. The processor system of claim 9, wherein said processor is programmed to calculate said air/fuel ratio from the following formula:

$$A/F=(A/F)_o+SIGN(EGO)*(\alpha F(ts)+(\beta G(\Theta', v')),$$

where A/F represents said air/fuel ratio, $(A/F)_o$ represents a stoichiometric air/fuel ratio, SIGN(EGO) represents said positive/negative pulse signal, F(ts) represents a function of said duration times, $G(\Theta', v')$ represents a function of said derivative values, and $\alpha$ and $\beta$ are weighing factors.

12. The processor system of claim 9, wherein said memory stores a driving conditions function of said throttle position derivative values and said vehicle speed derivative values, and wherein said processor calculates said air/fuel ratio from values of said driving conditions function.

* * * * *